US007999188B2

(12) United States Patent
Perego et al.

(10) Patent No.: US 7,999,188 B2
(45) Date of Patent: Aug. 16, 2011

(54) ENERGY CABLE

(75) Inventors: Gabriele Perego, Milan (IT); Alberto Bareggi, Milan (IT); Sergio Belli, Milan (IT)

(73) Assignee: Prysmian S.p.A., Milan (IT)

( * ) Notice: Subject to any disclaimer, the term of this patent is extended or adjusted under 35 U.S.C. 154(b) by 0 days.

(21) Appl. No.: 12/452,279

(22) PCT Filed: Jun. 28, 2007

(86) PCT No.: PCT/EP2007/056473

§ 371 (c)(1),
(2), (4) Date: Mar. 15, 2010

(87) PCT Pub. No.: WO2009/000326

PCT Pub. Date: Dec. 31, 2008

(65) Prior Publication Data

US 2010/0163269 A1 Jul. 1, 2010

(51) Int. Cl.
*H01B 7/00* (2006.01)

(52) U.S. Cl. ..... 174/120 R

(58) Field of Classification Search ..... 174/120 R, 174/121 A

See application file for complete search history.

(56) References Cited

U.S. PATENT DOCUMENTS

| | | | | |
|---|---|---|---|---|
| 4,348,459 | A | 9/1982 | Drzal et al. | |
| 4,543,207 | A | 9/1985 | Sato et al. | |
| 4,621,302 | A | 11/1986 | Sato et al. | |
| 4,857,673 | A | 8/1989 | Wilkus et al. | |
| 5,017,733 | A | 5/1991 | Sato et al. | |
| 5,192,463 | A | 3/1993 | Berger et al. | |
| 5,446,228 | A | 8/1995 | Commandeur et al. | |
| 5,545,355 | A | 8/1996 | Commandeur et al. | |
| 5,601,755 | A | 2/1997 | Commandeur et al. | |
| 5,718,974 | A | 2/1998 | Kmiec | |
| 5,889,087 | A | 3/1999 | Hayashi et al. | |
| 6,001,933 | A | 12/1999 | Tsuruoka et al. | |
| 6,231,978 | B1 * | 5/2001 | Keogh | 428/378 |
| 6,232,377 | B1 * | 5/2001 | Hayashi et al. | 524/100 |
| 6,441,309 | B1 * | 8/2002 | Jow et al. | 174/110 R |
| 6,492,475 | B1 * | 12/2002 | Egashira et al. | 526/153 |
| 6,562,907 | B2 | 5/2003 | Johoji et al. | |

(Continued)

FOREIGN PATENT DOCUMENTS

EP 0 987 718 A1 3/2000

(Continued)

OTHER PUBLICATIONS

European Search Report for International Application No. PCT/EP2007/056473, mailing date Apr. 23, 2008.

(Continued)

*Primary Examiner* — Chau N Nguyen

(74) *Attorney, Agent, or Firm* — Finnegan, Henderson, Farabow, Garrett & Dunner, L.L.P.

(57) ABSTRACT

A cable for transporting or distributing electric energy, especially medium or high voltage electric energy, includes at least one electrical conductor, at least one electrically insulating layer surrounding the electrical conductor, and at least one sheath surrounding the electrically insulating layer, wherein the sheath includes 65% to 95% by weight of at least one thermoplastic ethylene polymer; 5% to 35% by weight of at least one plasticizing agent, the percentages being expressed with respect to the total weight of the sheath. The above sheath guarantees improved flexibility without impairing mechanical properties and particularly thermopressure resistance, which is essential to preserve shape and integrity of the screen layer during cable installation and use at high operating temperatures.

35 Claims, 1 Drawing Sheet

U.S. PATENT DOCUMENTS

| | | | | |
|---|---|---|---|---|
| 7,196,270 | B2 | 3/2007 | Perego et al. | |
| 2002/0120065 | A1 | 8/2002 | Johoji et al. | |
| 2003/0060525 | A1 | 3/2003 | Gupta | |
| 2005/0205290 | A1* | 9/2005 | Pinacci et al. | 174/121 A |
| 2006/0124341 | A1* | 6/2006 | Perego et al. | 174/110 R |
| 2006/0135699 | A1* | 6/2006 | Li et al. | 525/240 |
| 2006/0189744 | A1 | 8/2006 | Tse et al. | |
| 2009/0211782 | A1* | 8/2009 | Perego et al. | 174/120 SR |
| 2010/0126756 | A1* | 5/2010 | Perego et al. | 174/25 |

FOREIGN PATENT DOCUMENTS

| | | | |
|---|---|---|---|
| GB | 571943 | | 9/1945 |
| WO | WO 97/03124 | A1 | 1/1997 |
| WO | WO 98/32137 | | 7/1998 |
| WO | WO 98/52197 | A1 | 11/1998 |
| WO | WO 99/13477 | | 3/1999 |
| WO | WO 00/41187 | | 7/2000 |
| WO | WO 01/37289 | A1 | 5/2001 |
| WO | WO 02/03398 | A1 | 1/2002 |
| WO | WO 02/27731 | A1 | 4/2002 |
| WO | WO 02/47092 | A1 | 6/2002 |
| WO | WO 2004/066317 | A1 | 8/2004 |
| WO | WO 2004/066318 | A1 | 8/2004 |
| WO | WO 2006/000244 | * | 1/2006 |
| WO | WO 2007/048422 | A1 | 5/2007 |

OTHER PUBLICATIONS

ASTM D 790-95a, Standard Test Methods for Flexural Properties of Unreinforced and Reinforced Plastics and Electrical Insulating Materials (Publ. 1996).

CEI EN 60811-3-1, Insulating and Sheathing Materials of Electrical Cables, Part 3: Methods Specific to PVC Compounds, Section 1: Pressure Test at High Temperature- Tests for Resistance to Cracking (Aug. 1, 2001).

CEI IEC 60247, Insulating Liquids—Measurement of Relative Permittivity, Dielectric Dissipating Factor and DC Resistivity (3rd Ed. Feb. 2004).

Office Action mailed Oct. 7, 2009, for U.S. Appl. No. 12/083,101.

Notice of Allowance mailed Jun. 14, 2010, for U.S. Appl. No. 12/083,101.

Notice of Allowance mailed Sep. 29, 2010, for U.S. Appl. No. 12/083,101.

International Search Report for PCT/EP2005/011437, mailed May 22, 2006.

* cited by examiner

ENERGY CABLE

CROSS REFERENCE TO RELATED APPLICATION

This application is a national phase application based on PCT/EP2007/056473, filed Jun. 28, 2007, the content of which is incorporated herein by reference.

BACKGROUND OF THE INVENTION

The present invention relates to an energy cable. In particular, the present invention relates to a cable for transporting or distributing electric energy, especially medium or high voltage electric energy, said cable having a sheath which guarantees to the cable improved flexibility combined with high mechanical strength and thermopressure resistance. Said cable may be used for either direct current (DC) or alternating current (AC) transmission or distribution.

Cables for transporting electric energy generally include at least one cable core. The cable core is usually formed by at least one conductor sequentially covered by an inner polymeric layer having semiconductive properties, an intermediate polymeric layer having electrically insulating properties, an outer polymeric layer having semiconductive properties. Cables for transporting medium or high voltage electric energy generally include at least one cable core surrounded by at least one screen layer, typically made of metal or of metal and polymeric material. The screen layer can be made in form of wires (braids), a tape helically wound around the cable core or a sheet longitudinally surrounding the cable core. The polymeric layers surrounding the at least one conductor are commonly made from a polyolefin-based crosslinked polymer, in particular crosslinked polyethylene (XLPE), or elastomeric ethylene/propylene (EPR) or ethylene/propylene/diene (EPDM) copolymers, also crosslinked, as disclosed, e.g., in WO 98/52197. The crosslinking step, carried out after extruding the polymeric material onto the conductor, gives the material satisfactory mechanical and electrical properties even under high temperatures both during continuous use and with current overload. To address requirements for materials which should not be harmful to the environment both during production and during use, and which should be recyclable at the end of the cable life, energy cables have been recently developed having a cable core made from thermoplastic materials, i.e. polymeric materials which are not crosslinked and thus can be recycled at the end of the cable life.

In this respect, WO 02/03398 and WO 02/27731, both in the Applicant's name, disclose cables comprising at least one electrical conductor and at least one extruded covering layer based on thermoplastic polymer material in admixture with a dielectric liquid, wherein said thermoplastic material comprises a propylene homopolymer or a copolymer of propylene with at least one olefin comonomer selected from ethylene and an alpha-olefin other than propylene, said homopolymer or copolymer having a melting point greater than or equal to 140° C. and a melting enthalpy of from 30 J/g to 100 J/g. Alternatively, as thermoplastic base material, a propylene homopolymer or copolymer as hereinbefore defined can be used in mechanical mixture with a low crystallinity polymer, generally with a melting enthalpy of less than 30 J/g, which mainly acts to increase flexibility of the material. The quantity of low crystallinity polymer is generally less than 70 wt %, and preferably from 20 to 60 wt %, on the total weight of the thermoplastic material.

WO 04/066318, in the Applicant's name, refers to a cable comprising at least one electrical conductor and at least one extruded covering layer based on a thermoplastic polymer material in admixture with a dielectric liquid, wherein said thermoplastic polymer material is selected from:

(a) at least one propylene homopolymer or at least one copolymer of propylene with at least one olefin comonomer selected from ethylene and an alpha-olefin other than propylene, said homopolymer or copolymer having a melting point greater than or equal to 130° C. and a melting enthalpy of from 20 J/g to 100 J/g;

(b) a mechanical mixture comprising at least one propylene homopolymer or copolymer (a) and (c) at least one elastomeric copolymer of ethylene with at least one aliphatic alpha-olefin, and optionally a polyene. The elastomeric copolymer of ethylene (c) has a melting enthalpy of less than 30 J/g. The quantity of said elastomeric copolymer (c) is generally less than 70% by weight, preferably of from 20% by weight to 60% by weight, with respect to the total weight of the thermoplastic base material.

To mechanically protect the cable core against impacts and compressions, generally energy cables further comprise at least one polymeric coating layer placed in a radially outer position with respect to the cable core, and with respect to the screen layer when it is present, usually known as sheath or outer sheath.

U.S. Pat. No. 4,348,459 relates to a thermoplastic elastomeric composition suitable for making electrical plugs, connectors and cable jacketing comprising a blend of:

(a) ethylene-propylene-non-conjugated diene terpolymer rubber having an ethylene content of from 70 to 85% by weight and a gel content of from 10 to 45%, preferably 15 to 35%, by weight measured in cyclohexane at room temperature;

(b) an essentially crystalline propylene polymer;

(c) a naphthenic or paraffinic extender oil; and (d) an inorganic (non-black) filler suitable to absorb at least a portion of said extender oil (c);

wherein the weight ratio of (a)/(b) is from 90/10 to 25/75, preferably from 80/20 to 40/60, the concentration of (c) is from 20 to 100 parts per 100 parts by weight of (a) plus (b), the concentration of (d) is from 10 to 100 parts per 100 parts by weight of (a) plus (b), and the weight ratio of (c)/(d) does not exceed 2.5/1.

The above compositions are characterized by unusual resistance to high temperatures and they therefore provide an improved margin of safety over material commonly used for electrical insulation, especially polyvinylchloride.

WO 97/03124 relates to a cable-sheathing composition, as well as the use thereof as outer sheathing for a power cable or a communication cable. In particular, this document discloses a cable-sheathing composition consisting of a multimodal olefin polymer mixture having a density of about 0.915-0.955 kg/dm$^3$ and a melt flow rate of about 0.1-0.3 g/10 min, said olefin polymer mixture comprising at least a first and a second olefin polymer, of which the first has a density and a melt flow rate selected from (a) about 0.930-0.975 kg/dm$^3$ and about 50-2000 g/10 min and (b) about 0.88-0.93 kg/dm$^3$ and about 0.1-0.8 g/10 min.

The above multimodal olefin polymer mixtures would result in improved cable-sheathing compositions, especially as regards shrinkage, environmental stress cracking resistance (ESCR) and processability.

U.S. Pat. No. 5,718,974 relates to a cable having a jacket comprising an in situ blend of two co-polymers of ethylene and one or more alpha-olefins having 3 to 12 carbon atoms, said blend having a Mw/Mn ratio in the range of about 8 to about 22; a melt index in the range of about 0.2 to about 3.5 grams per 10 minutes; a melt flow ratio in the range of about 55 to about 135; a molecular weight in the range of about 90,000 to about 250,000; and a density of at least 0.915 kg/dm$^3$.

The above blend would be endowed with high tensile strength, high elongation, and improved low temperature brittleness as compared with linear low density polyethylene (LLDPE) while maintaining the other advantageous properties of LLDPE, and which is based on a more easily extrudable resin comparable to LLDPE.

Additives, which can be introduced into the in situ blend, are exemplified, inter alia, by plasticizers. Additives can be added in amounts ranging from about 0.01 to about 10 parts by weight for each 100 parts by weight of the base resin (from 0.01% and 9.1% by weight). Said amount is referred to all of the additives without any information about the quantity of plasticizers to be used.

US 2006/0189744 relates to articles comprising plasticized thermoplastic polyolefin compositions comprising one or more thermoplastic polyolefins, one or more non-functionalized plasticizers (NFP), and one or more nucleating agents. The thermoplastic polyolefin may be a polypropylene or propylene polymer, i.e. a polymer made of at least 50 mole % of propylene units and having less than 35 mole % of ethylene units. Alternatively, the polyolefin may be a polyethylene or ethylene polymer, i.e. a polymer made of at least 50 mole wt % of ethylene units and having less than 20 mole % of propylene units.

The NFP is a hydrocarbon liquid which does not include to an appreciable extent functional groups selected from hydroxide, aryls and substituted aryls, halogens, alkoxys, carboxylates, esters, carbon unsaturation, acrylates, oxygen, nitrogen, and carboxyl. Preferably, the NFPs include isoparaffins, PAOs, Group III basestocks or mineral oils, high purity hydrocarbon fluids derived from a so-called Gas-To-Liquids processes, and mineral oils with a viscosity index greater than 100, pour point less than −20° C., specific gravity less than 0.86, and flash point greater than 200° C. The amount of NFPs may vary within a wide range of values, generally from 60 to 0.1 wt %, or even at 5 wt % or less, based upon the total weight of the composition.

The articles that can be produced by means of the above compositions are, among many others, wire and cable jacketing.

The teachings of the above-mentioned document are directed to solve a problem regarding satisfactory aesthetics in a molded article, because plasticization causes certain types of thermoplastic polyolefins, especially polypropylene, to exhibit undesirable optical and/or tactile properties, especially at low temperature.

SUMMARY OF THE INVENTION

The Applicant has faced the problem of increasing the flexibility of a cable for transporting or distributing electric energy, especially medium or high voltage electric energy. The flexibility is a property particularly appreciated when installing the cable or during any manipulation of the same, for instance when mounting cable accessories such as joints and terminals.

A relevant influence on cable flexibility is exerted by the insulating layer, which usually has a remarkable thickness, however ad hoc modifications of the insulating material are troublesome because any modification may have a negative impact on the electrical properties thereof. Therefore, other cable components should be taken into account to modify the overall flexibility of the finished cable.

In this respect, the contribution of the sheath to the overall flexibility of the cable is of the utmost importance, both because its thickness is not negligible (usually about 2.5 mm), and because of its outermost position in the cable design: the higher is the distance of a cable component from the cable axis, the higher is the contribution of that component to the cable rigidity.

Besides flexibility, the outer sheath must satisfy other requirements to be suitable for energy cables, especially for medium or high voltage, in particular mechanical properties such as abrasion resistance, environmental stress cracking resistance (ESCR), tensile strength, shrinkage at 80° C. and thermopressure resistance, i.e. a low reduction of the sheath thickness upon application of a compression force at the operating temperature of the cable. These properties should be achieved with materials that can be easily processed. Keeping the overall cost of the finished cable within acceptable limits is desirable.

In an attempt to solve the above technical problem, the Applicant noticed that the use of polymeric materials of high flexibility, such as flexibilized polyvinylchloride (PVC), for the outer sheath of medium or high voltage cables, may cause some drawbacks during installation and use of the cable. Particularly, the Applicant has noticed that, when the cable is bended, the screen layer, made in the form of a sheet comprising a metal such as aluminum and longitudinally surrounding the cable core, may be subject to irreversible deformations (yielding) which may cause premature failure of the cable.

Besides the specific problems due to the presence of a screen layer, the use of halogenated materials such as PVC should be avoided because of the well known safety and environmental concerns.

The Applicant has now found that it is possible to improve the flexibility of a cable and to guarantee, at the same time, the cable integrity and durability by providing the cable with a sheath comprising at least one thermoplastic ethylene polymer mixed with at least one plasticizing agent in a selected amount so as to provide the cable with the desired flexibility without impairing mechanical properties and particularly thermopressure resistance, which is essential to preserve shape and integrity of the screen layer during cable installation and use at high operating temperatures.

Therefore, in a first aspect the present invention relates to a cable comprising at least one electrical conductor, at least one electrically insulating layer surrounding said electrical conductor, and at least one sheath surrounding said electrically insulating layer, wherein said sheath comprises: from 65% to 95% by weight, preferably from 70% to 90% by weight, even more preferably from 75% to 88% by weight, of at least one thermoplastic ethylene polymer; from 5% to 35% by weight, preferably from 10% to 30% by weight, even more preferably from 12% to 25% by weight, of at least one plasticizing agent, the percentages being expressed with respect to the total weight of the sheath.

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

In the present description and in the subsequent claims, as "conductor" it is meant an electrically conducting element of elongated shape, usually made from a metallic material, more preferably aluminium, copper or alloys thereof, either as a rod or as a stranded multi-wire, or a conducting element as above coated with a semiconductive layer.

For the purposes of the invention the term "medium voltage" generally means a voltage of between 1 kV and 35 kV, whereas "high voltage" means voltages higher than 35 kV. As "electrically insulating layer" it is meant a covering layer made of a material having insulating properties, namely a having a dielectric rigidity of at least 5 kV/mm, preferably greater than 10 kV/mm.

As "semiconductive layer" it is meant a covering layer made of a material having semiconductive properties, such as a polymeric matrix added with, e.g., carbon black such as to obtain a volumetric resistivity value, at room temperature, of less than 500 Ωm, preferably less than 20 Ωm. Typically, the amount of carbon black can range between 1 and 50% by weight, preferably between 3 and 30% by weight, relative to the weight of the polymer.

As "sheath", it is meant a covering layer applied outermost to a wire or cable.

As "plasticizing agent" it is meant a fluid based on a single compound or on a mixture of compounds which, when mixed in a polymer matrix, is capable to soften the final product increasing its flexibility.

As "thermoplastic ethylene polymer" it is meant an ethylene homopolymer or copolymer of ethylene with at least one alpha-olefin, which is substantially not crosslinked and has a substantially crystalline structure so as to melt when heated.

The cable of the present invention can be a low, medium or high voltage cable.

Advantageously, the cable of the invention is a medium or high voltage cable.

Advantageously, the cable of the invention comprises at least one screen layer surrounding said electrically insulating layer and surrounded by said sheath.

Preferably, the thermoplastic ethylene polymer is an ethylene homopolymer or copolymer of ethylene with at least one $C_3$-$C_{12}$ alpha-olefin, having a density of from 0.900 to 0.955 kg/dm$^3$, preferably from 0.910 to 0.940 kg/dm$^3$.

In the case of an ethylene copolymer, the at least one $C_3$-$C_{12}$ alpha-olefin is present in an amount of from 1 to 15% by mole, preferably from 1.5 to 8% by mole.

Preferably, the thermoplastic ethylene polymer has a melting enthalpy ($\Delta H_m$) of at least 90 J/g, preferably of from 100 to 120 J/g. The melting enthalpy can be determined by Differential Scanning Calorimetry (DSC) analysis.

Preferably, the thermoplastic ethylene polymer has a melt flow rate higher than 0.1 g/10 min, more preferably higher than 1 g/10 min. Preferably the melt flow rate of the thermoplastic ethylene polymer is equal to or lower than 10 g/10 min.

With "$C_3$-$C_{12}$ alpha-olefin" it is meant an olefin of formula $CH_2{=}CH{-}R$, wherein R is a linear or branched alkyl having from 1 to 10 carbon atoms. The alpha-olefin may be selected, for example, from: propylene, 1-butene, 1-pentene, 4-methyl-1-pentene, 1-hexene, 1-octene, 1-dodecene. Among them, 1-butene, 1-hexene and 1-octene are particularly preferred.

The thermoplastic ethylene polymer is preferably selected from: medium density polyethylene (MDPE) having a density of from 0.926 to 0.940 kg/dm$^3$, low density polyethylene (LDPE) and linear low density polyethylene (LLDPE) having a density of from 0.910 to 0.926 kg/dm$^3$. LLDPE is particularly preferred.

The above thermoplastic ethylene polymers may be produced according to well known techniques. More specifically, MDPE may be prepared by a low to medium pressure ethylene homopolymerization in the presence of a Ziegler-Natta catalyst, which produces an ethylene homopolymer with a very low branching degree. LDPE is generally produced by a high-pressure process wherein ethylene is homopolymerized in the presence of oxygen or a peroxide as initiator, giving rise to long-branched polyethylene chains. LLDPE is a short-branched copolymer of ethylene with at least one $C_3$-$C_{12}$ alpha-olefin, and may be prepared according to a low-pressure process in the presence of a Ziegler-Natta catalyst or a chromium-based catalyst.

Preferably, the plasticizing agent is selected from: paraffines, cycloparaffines, aromatic and polyaromatic hydrocarbons, esters, ethers, mineral oils. Examples of plasticizing agents suitable to the present invention are naphthenic, paraffinic, aromatic compounds. Examples of commercially available plasticizing agent suitable for the invention are: Jarylec® Exp4 and Exp3 (marketed by Elf Atochem); Nyflex® 820, Nytex® 800 and 840 (marketed by Nynas); Sunpar® 2280 (marketed by Sunoco); Synesstic™ 5 and 12 (marketed by ExxonMobil Chemical); Palatinol® AH (marketed by BASF).

Preferably, the plasticizing agent is a fluid having a boiling point of at least 250° C.

Preferably, the plasticizing agent is a fluid having a viscosity of at least 3 cSt at 40° C.

Preferably, the plasticizing agent has a density, measured at 15° C. according to ASTM Standard D 4052, not lower than 0.88 kg/dm$^3$.

Preferably, the plasticizing agent has a density, measured at 15° C. according to ASTM Standard D 4052, not higher than 1.50 kg/dm$^3$ Density values not lower than 0.88 kg/dm$^3$ are particularly preferred to substantially avoid migration of the plasticizing agent onto the polymeric material surface during cable production (which may cause undesired slippage of the polymeric material during the extrusion process) and in the finished cable (the presence of substantial amounts of the plasticizing agent on the sheath surface may cause inconveniences when handling the cable, for instance during installation).

Furthermore, a plasticizer with a density value not lower than 0.88 kg/dm$^3$ avoids an impairment of the thermopressure resistance of the sheath under the cable operation condition temperature that, on the average, ranges from room temperature to 80° C. or more.

The plasticizing agent is liquid at room temperature, has a boiling point higher than 250° C. at 760 Torr, shows physicochemical compatibility with the polyolefin, revealed by single phase morphology as detected by microscopic investigation. The reduction of the elastic modulus of the polymeric material containing at least one plasticizing agent is proportional to the concentration of the latter.

According to a preferred embodiment, in the cable according to the invention the at least one sheath further comprises at least one ultra-low density ethylene copolymer, having a density of from 0.860 to 0.899 kg/dm$^3$, preferably from 0.865 to 0.880 kg/dm$^3$. The amount of the at least one ultra-low density ethylene copolymer is generally not higher than 30% by weight, preferably of from 0% by weight to 20% by weight, with respect to the total weight of the polymeric components of the sheath.

Preferably, the ultra-low density ethylene copolymer has a Molecular Weight Distribution Index (MWDI), defined as the ratio between the weight-average molecular weight $M_w$ and the number-average molecular weight $M_n$, not higher than 5, preferably of from 1.5 to 3.5. The MWDI may be determined, according to conventional methods, by Gel Permeation Chromatography (GPC).

Generally, the ultra-low density ethylene copolymer is a copolymer of ethylene with at least one $C_3$-$C_{12}$ alpha-olefin, said alpha-olefin being defined as above, and optionally with at least one $C_4$-$C_{20}$ diene. Preferably the alpha-olefin is a $C_4$-$C_8$ alpha-olefin.

The $C_4$-$C_{20}$ diene is preferably selected from: linear, conjugated or non-conjugated diolefins, for example 1,3-butadiene, 1,4-hexadiene or 1,6-octadiene; monocyclic or polycyclic dienes, for example 1,4-cyclohexadiene, 5-ethylidene-2-norbornene, 5-methylene-2-norbornene.

The ultra-low density ethylene copolymer has preferably the following monomer composition: from 82% by mole to 99% by mole, preferably from 93% by mole to 98% by mole, of ethylene; from 1% by mole to 18% by mole, preferably from 2% by mole to 13% by mole, of at least one $C_3$-$C_{12}$ alpha-olefin; from 0 to 5% by mole, preferably from 0 to 2% by mole, of at least one diene. Examples of commercially available ultra-low density ethylene copolymers suitable for the present invention are those marketed by The Dow Chemical Company under the trademark Engage™.

The ultra-low density ethylene copolymers may be produced according to known techniques, particularly by copolymerization of ethylene with at least one $C_3$-$C_{12}$ alpha-olefin, and optionally with at least one $C_4$-$C_{20}$ diene, in the presence of a single-site catalyst, more preferably a metallocene catalyst, or a constrained-geometry catalyst.

Other components may be added in minor amounts to produce the cable sheath according to the present invention, such as antioxidants, stabilizers, pigments, surfactants.

Conventional antioxidants suitable for the purpose are, for example, distearyl- or di-lauryl-thiopropionate and pentaerythrityl-tetrakis [3-(3,5-di-t-butyl-4-hydroxyphenyl)-propionate], or mixtures thereof. Examples of commercially available antioxidants suitable for the invention are: EFKA® 8300, EFKA® 8350, EFKA® 8530, EFKA® 8590, Irgafos® 126, Irgafos® 168, Irgafos® 38, Irganox® 1010, Irganox® 1076, Irganox® 1081, Irganox® 1098, Irganox® B 220, Irganox® B 921, Irganox® PS 800 (all marketed by CIBA).

Conventional stabilizers suitable for the purpose are, for example, benzophenones, hindered amines or hindered amides. Examples of commercially available of stabilizers suitable for the invention are: Shelfplus® UV 1400, Tinuvin® 326, Tinuvin® 327, Tinuvin® 622, Tinuvin® 770, Tinuvin® 783, Tinuvin® 791 (all marketed by CIBA).

The thermoplastic ethylene polymer, the plasticizing agent and any additional minor components are mixed together by using methods known in the art, to provide a substantially homogeneous dispersion of the plasticizing agent into the polymer matrix. Mixing may be carried out for example by an internal mixer of the type with tangential rotors (Banbury) or with interpenetrating rotors; in a continuous mixer of Ko-Kneader (Buss) type, of co- or counter-rotating double-screw type; or in a single screw extruder.

If an ultra-low density ethylene copolymer is present, this can be pre-mixed with the thermoplastic ethylene polymer, or mixed together with the other components.

Preferably, the cable of the present invention comprises at least one covering layer selected from an insulating layer, a semiconductive layer or a combination thereof, said at least one covering layer being based on a thermoplastic polymer material, though cross-linked polymer materials are not excluded.

In an embodiment of the present invention, the cable comprises at least one covering layer selected from an insulating layer, a semiconductive layer or a combination thereof, said at least one covering layer being based on a thermoplastic polymer material in admixture with a dielectric liquid, wherein:

said thermoplastic polymer material is selected from:

(a) at least one propylene homopolymer or at least one copolymer of propylene with at least one olefin comonomer selected from ethylene and an alpha-olefin other than propylene, said homopolymer or copolymer having a melting point greater than or equal to 130° C. and a melting enthalpy of from 20 J/g to 100 J/g;

(b) a mechanical mixture comprising at least one propylene homopolymer or copolymer (a) and (c) at least one elastomeric copolymer of ethylene with at least one aliphatic alpha-olefin, and optionally a polyene;

the concentration by weight of said dielectric liquid in said thermoplastic polymer material is lower than the saturation concentration of said dielectric liquid in said thermoplastic polymer material.

In another embodiment of the present invention, the cable comprises at least one covering layer selected from an insulating layer, a semiconductive layer or a combination thereof based on a thermoplastic polymer material in admixture with a dielectric liquid, wherein said thermoplastic polymer material comprises (i) at least 75% by weight, with respect to the total weight of the thermoplastic polymer material, of at least one copolymer of at least two α-olefin comonomers, said copolymer having a melting enthalpy lower than 25 J/g; and (ii) an amount equal to or less than 25% by weight with respect to the total weight of the thermoplastic polymer material of at least one propylene homopolymer or propylene copolymer with at least one alpha-olefin, said at least one propylene homopolymer or propylene copolymer having a melting enthalpy higher than 25 J/g and a melting point higher than 130° C.;

and wherein said covering layer has a melting enthalpy equal to or lower than 40 J/g, and the concentration by weight of said dielectric liquid in said thermoplastic polymer material is lower than the saturation concentration of said dielectric liquid in said thermoplastic polymer material.

BRIEF DESCRIPTION OF THE DRAWING

Further characteristics will be apparent from the detailed description given hereinafter with reference to the accompanying drawing, in which.

DETAILED DESCRIPTION OF THE PREFERRED EMBODIMENTS

Figure 1:
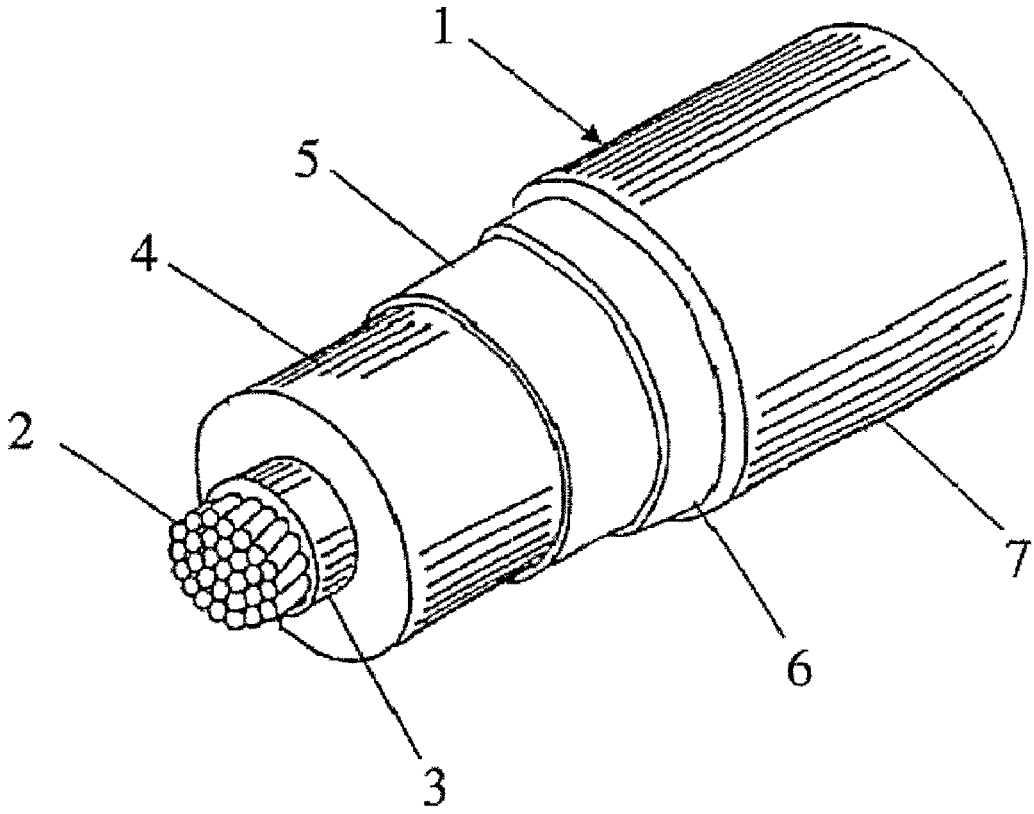
FIG. 1 is a perspective view of an energy cable, particularly suitable for medium or high voltage, according to the invention.

In FIG. 1, the cable (1) comprises a conductor (2), an inner layer with semiconductive properties (3), an intermediate layer with insulating properties (4), an outer layer with semiconductive properties (5), a metal screen layer (6), and a sheath (7).

The conductor (2) generally consists of metal wires, preferably of copper or aluminium or alloys thereof, stranded together by conventional methods, or of a solid aluminium or copper rod.

The insulating layer (4) may be produced by extrusion of a polymeric material around the conductor (2). The polymeric material is generally based on: (i) polyolefins such as: polyethylene (PE), particularly low density polyethylene (LDPE), linear low density polyethylene (LLDPE), medium density polyethylene (MDPE), high density polyethylene (HDPE); polypropylene (PP); thermoplastic propylene/ethylene copolymers; ethylene-propylene rubbers (EPR); ethylene-propylene-diene rubbers (EPDM); ethylene/unsaturated ester copolymers such as: ethylene/vinyl acetate copolymer (EVA), ethylene/methyl acrylate copolymer (EMA), ethylene/ethyl acrylate copolymer (EEA), ethylene/butyl acrylate copolymer (EBA); or mixtures thereof. The semiconductive layers (3) and (5) are also made by extruding polymeric materials based on polymers selected from those indicated above for the insulating layer (4), with the addition of carbon black in an amount sufficient to impart semiconductive properties.

Usually the polymeric materials of the insulating and semiconductive layers are then subjected to cross-linking by means of organic peroxide initiators or by means of hydrolyzable silane groups, according to well known techniques.

Preferably, the insulating layer (4) and the semiconductive layers (3) and (5) are made of a non-cross-linked thermoplastic polymer material in admixture with a dielectric liquid. The thermoplastic material may comprise a propylene homopolymer or a copolymer of propylene with at least one olefin comonomer selected from ethylene and an alpha-olefin other than propylene, said homopolymer or copolymer preferably having a melting point greater than or equal to 130° C. and a melting enthalpy of from 20 J/g to 100 J/g. These propylene polymers may be used in mechanical admixture with a low crystallinity polymer, such as an elastomeric copolymer of ethylene, having a melting enthalpy of, e.g., less than 20 J/g, which mainly acts to increase flexibility of the material. In this respect, see e.g. the above-cited WO 02/03398, WO 02/27731, WO 04/066318 or WO 07/048,422 in the Applicant's name.

Around the outer semiconductive layer (5), a metal screen layer (6) is positioned, generally made of electrically conducting wires or strips helically wound around the cable core. The electrically conducting material of said wires or strips is usually copper or aluminium or alloys thereof.

This screen layer is then covered by a sheath (7) according to the present invention, usually applied by extrusion.

The cable can be also provided with a protective structure (not shown in FIG. 1) the main purpose of which is to mechanically protect the cable against impacts or compressions. This protective structure may be, for example, a metal reinforcement or a layer of expanded polymer as described in WO 98/52197 in the name of the Applicant. The cable according to the present invention may be manufactured in accordance with known methods, for example by extrusion of the various layers around the central conductor. The extrusion of two or more layers is advantageously carried out in a single pass, for example by the tandem method in which individual extruders are arranged in series, or by co-extrusion with a multiple extrusion head. When required, after the extrusion step the cable core is cross-linked according to well known techniques. The screen layer is then applied around the so produced cable core. Finally, the sheath according to the present invention is applied, usually by a further extrusion step.

FIG. 1 shows only one embodiment of a cable according to the invention. Suitable modifications can be made to this embodiment according to specific technical needs and application requirements without departing from the scope of the invention.

The following examples illustrate the invention, but without limiting it.

Examples 1-5

The following compositions were prepared with the amounts reported in Table 1 (expressed as % by weight with respect to the total weight of the composition).

The compositions were prepared in an open type mixer fed with raw materials at 14° C. After having completed the melting step, mixing was started and carried out for 15 minutes, than the material was collected. Specimens for mechanical testing were prepared by compression molding at 130° C.

TABLE 1

| EXAMPLE | 1 (*) | 2 | 3 | 4 | 5 |
|---|---|---|---|---|---|
| BPD 3220 | 98 | 88 | 83 | 78 | 68 |
| Nyflex ® 222 | — | 10 | 15 | 20 | 30 |
| stabilizer | 2 | 2 | 2 | 2 | 2 |
| antioxidant | 0.2 | 0.2 | 0.2 | 0.2 | 0.2 |

(*) comparative

BPD 3220 (BP Petrochemicals): linear low density polyethylene (ethylene/1-butene copolymer with a content of 4% by weight, i.e. 2.08% by mole, of 1-butene comonomer) having: density=0.920 kg/dm$^3$; Melt Flow Rate (MFR)=2.4 g/10 min Nyflex® 222 (Nynas): naphthenic oil having: density at 15° C.=0.893 kg/dm$^3$; Viscosity at 40° C.=100 cSt; Viscosity at 100° C.=9 cSt.

From the above compositions specimens were obtained in the form of plates 1 mm-thick or 3 mm-thick, depending on the requirement of the standard tests. The plates were moulded at 195° C. with 15 min preheating.

The so obtained specimens were tested to determine: mechanical properties, thermopressure resistance at 110° C. and 115° C.; flexural modulus according to ASTM D 790; shrinkage at 80° C. for 5 hours (the test was repeated for 5 days according to CEI EN 2034-01; the shrinkage must result lower than 3% according to CEI 20-11).

The results are reported in Table 2:

TABLE 2

| EXAMPLE | 1 (*) | 2 | 3 | 4 | 5 |
|---|---|---|---|---|---|
| Mechanical properties: | | | | | |
| Tensile strength (MPa) | 21.6 | 19.7 | 17.2 | 13.7 | 11.0 |
| Elongation at break (%) | 965 | 1065 | 1195 | 1160 | 1295 |
| Thermopressure resistance | | | | | |
| at 110° C. | 95 | 99.3 | 96.6 | 95.8 | 94.9 |
| at 115° C. | — | 98.7 | 95.3 | 92.4 | 85.9 |
| Flexural modulus (MPa) | 358 | 227 | 204 | 185 | 152 |
| Shrinkage (%) | 1 | 1.3 | 1.2 | 1.4 | 1.4 |

(*) comparative

In the absence of a plasticizing agent (Example 1) the flexibility of the sample is poor. The Applicant experienced that amount of plasticizing agent lower than 5 wt % do not appreciably improve the flexibility of the sheath material.

Examples 6-11

The following compositions were prepared with the amounts reported in Table 3 (expressed as % by weight with respect to the total weight of the composition), following the same conditions reported for Examples 1-5.

TABLE 3

| EXAMPLE | 6 (*) | 7 | 8 | 9 (*) | 10 | 11 |
|---|---|---|---|---|---|---|
| BPD 3220 + Engage ® 8452 | 98 | 88 | 83 | 98 | 88 | 83 |
| weight ratio BPD 3220/Engage ® 8452 | 80/20 | 80/20 | 80/20 | 90/10 | 90/10 | 90/10 |
| Nyflex ® 222 | — | 10 | 15 | — | 10 | 15 |
| stabilizer | 2 | 2 | 2 | 2 | 2 | 2 |
| antioxidant | 0.2 | 0.2 | 0.2 | 0.2 | 0.2 | 0.2 |

(*) comparative

BPD 3220 (BP Petrochemicals): linear low density polyethylene (ethylene/1-butene copolymer with a content of 4% by weight, i.e. 2.08% by mole, of 1-butene comonomer) having: density=0.920 kg/dm$^3$; Melt Flow Rate (MFR)=2.4 g/10 min Engage® 8452 (Dow Chemical): ethylene/1-octene copolymer (content of 35% by weight, i.e. 11.9% by mole, of 1-octene comonomer) having: density=0.875 kg/dm3; Melt Flow Rate (MFR)=3 g/10 min.

Nyflex® 222 (Nynas): naphtenic oil having: density at 15° C.=0.893 kg/dm$^3$; Viscosity at 40° C.=100 cSt; Viscosity at 100° C.=9 cSt.

From the above compositions some specimens were obtained and tested as described above for Examples 1-5. The results are reported in Table 4:

TABLE 4

| EXAMPLE | 6 (*) | 7 | 8 | 9 (*) | 10 | 11 |
|---|---|---|---|---|---|---|
| Mechanical properties: | | | | | | |
| Tensile strength (MPa) | 23.0 | 16.9 | 15.9 | 21.7 | 18.8 | 16.3 |
| Elongation at break (%) | 957 | 1029 | 1088 | 894 | 1083 | 1087 |
| Modulus at 100% (MPa) | 7.3 | 5.9 | 5.3 | 7.8 | 6.5 | 5.8 |
| Modulus at 200% (MPa) | 7.5 | 6.0 | 5.4 | 8.1 | 6.6 | 6.0 |
| Thermopressure resistance at 110° C. | 90 | 86 | 81 | 97 | 93 | 92 |
| Flexural modulus (MPa) | 264 | 194 | 165 | 298 | 228 | 194 |
| Shrinkage (%) | 1 | 1 | 1 | 1 | 1 | 1 |

(*) comparative

The compounding of an ethylene polymer with an ultra-low density ethylene copolymer (Examples 6 and 9) does not provide a sheath with advantageous flexibility characteristics. The addition of a plasticizer provides the sheath material with the sought flexibility. However, it has been observed that in the presence of an ultra-low density copolymer, an excessively high amount of plasticizer (e.g. higher than 15% by weight in the case of Nyflex® 222) can:

impair the thermomechanical properties of the coating layer;

exudate out of the cable in operation.

The invention claimed is:

1. A cable comprising at least one electrical conductor, at least one electrically insulating layer surrounding said electrical conductor, and at least one sheath surrounding said electrically insulating layer, wherein said sheath comprises:

65% to 95% by weight of at least one thermoplastic ethylene polymer; and

5% to 35% by weight of at least one plasticizing agent, the percentages being expressed with respect to the total weight of the sheath, and wherein the at least one plasticizing agent is a fluid having a density, measured at 15° C. according to ASTM Standard D 4052, not lower than 0.88 kg/dm$^3$.

2. The cable according to claim 1, wherein said at least one thermoplastic ethylene polymer is present in an amount of 70% to 90% by weight.

3. The cable according to claim 2, wherein said at least one thermoplastic ethylene polymer is present in an amount of 75% to 88% by weight.

4. The cable according to claim 1, wherein said at least one plasticizing agent is present in an amount of 10% to 30% by weight.

5. The cable according to claim 4, wherein said at least one plasticizing agent is present in an amount of 12% to 25% by weight.

6. The cable according to claim 1, comprising at least one screen layer surrounding said at least one electrically insulating layer and surrounded by said at least one sheath.

7. The cable according to claim 1, wherein the at least one thermoplastic ethylene polymer is an ethylene homopolymer or copolymer of ethylene with at least one $C_3$-$C_{12}$ alpha-olefin, having a density of 0.900 to 0.955 kg/dm$^3$.

8. The cable according to claim 7, wherein the at least one thermoplastic ethylene polymer is an ethylene homopolymer or copolymer of ethylene with at least one $C_3$-$C_{12}$ alpha-olefin, having a density of 0.910 to 0.940 kg/dm$^3$.

9. The cable according to claim 7, wherein the at least one $C_3$-$C_{12}$ alpha-olefin is present in an amount of 1 to 15% by mole.

10. The cable according to claim 9, wherein the at least one $C_3$-$C_{12}$ alpha-olefin is present in an amount of 1.5 to 8% by mole.

11. The cable according to claim 7, wherein the $C_3$-$C_{12}$ alpha-olefin is selected from: propylene, 1-butene, 1-pentene, 4-methyl-1-pentene, 1-hexene, 1-octene, and 1-dodecene.

12. The cable according to claim 1, wherein the at least one thermoplastic ethylene polymer has a melting enthalpy of at least 90 J/g.

13. The cable according to claim 12, wherein the at least one thermoplastic ethylene polymer has a melting enthalpy of 100 to 120 J/g.

14. The cable according to claim 1, wherein the at least one thermoplastic ethylene polymer has a melt flow rate higher than 0.1 g/10 min.

15. The cable according to claim 14, wherein the at least one thermoplastic ethylene polymer has a melt flow rate higher than 1 g/10 min.

16. The cable according to claim 1, wherein the at least one thermoplastic ethylene polymer has a melt flow rate equal to or lower than 10 g/10 min.

17. The cable according to claim 1, wherein the at least one thermoplastic ethylene polymer is selected from: medium density polyethylene having a density of 0.926 to 0.940 kg/dm$^3$, low density polyethylene and linear low density polyethylene having a density of 0.910 to 0.926 kg/dm$^3$.

18. The cable according to claim 17, wherein the thermoplastic ethylene polymer is linear low density polyethylene.

19. The cable according to claim 1, wherein the at least one plasticizing agent is selected from: paraffins, cycloparaffins, aromatic and polyaromatic hydrocarbons, esters, ethers, and mineral oils.

20. The cable according to claim 1, wherein the at least one plasticizing agent is a fluid having a boiling point of at least 250° C. at 760 Torr.

21. The cable according to claim 1, wherein the at least one plasticizing agent is a fluid having a viscosity of at least 3 cSt at 40° C.

22. The cable according to claim 1, wherein the at least one plasticizing agent is a fluid having a density, measured at 15° C. according to ASTM Standard D 4052, not higher than 1.50 $kg/dm^3$.

23. The cable according to claim 1, wherein the at least one sheath comprises at least one ultra-low density ethylene copolymer having a density of 0.860 to 0.899 $kg/dm^3$.

24. The cable according to claim 23, wherein the at least one ultra-low density ethylene copolymer has a density of 0.865 to 0.880 $kg/dm^3$.

25. The cable according to claim 23, wherein the at least one ultra-low density ethylene copolymer is present in an amount not higher than 30% by weight, with respect to the total weight of polymeric components of the sheath.

26. The cable according to claim 25, wherein the at least one ultra-low density ethylene copolymer is present in an amount of 0% by weight to 20% by weight.

27. The cable according to claim 23, wherein the at least one ultra-low density ethylene copolymer has a Molecular Weight Distribution Index, defined as the ratio between the weight-average molecular weight and the number-average molecular weight, not higher than 5.

28. The cable according to claim 27, wherein the at least one ultra-low density ethylene copolymer has a Molecular Weight Distribution Index of 1.5 to 3.5.

29. The cable according to claim 23, wherein the at least one ultra-low density ethylene copolymer is a copolymer of ethylene with at least one $C_3$-$C_{12}$ alpha-olefin, or a copolymer of ethylene with at least one $C_3$-$C_{12}$ alpha-olefin and at least one $C_4$-$C_{20}$ diene.

30. The cable according to claim 29, wherein the at least one ultra-low density ethylene copolymer is a copolymer of ethylene with at least one $C_4$-$C_8$ alphaolefin, or a copolymer of ethylene with at least one $C_4$-$C_8$ alpha-olefin and at least one $C_4$-$C_{20}$ diene.

31. The cable according to claim 23, wherein the at least one ultra-low density ethylene copolymer comprises the following monomer composition: 82% by mole to 99% by mole of ethylene; 1% by mole to 18% by mole of at least one $C_3$-$C_{12}$ alpha-olefin; and 0 to 5% by mole of at least one diene.

32. The cable according to claim 31, wherein the at least one ultra-low density ethylene copolymer comprises the following monomer composition: 93% by mole to 98% by mole of ethylene; 2% by mole to 13% by mole of at least one $C_3$-$C_{12}$ alpha-olefin; and 0 to 2% by mole of at least one diene.

33. The cable according to claim 1, comprising at least one covering layer selected from an insulating layer, a semiconductive layer or a combination thereof, said at least one covering layer being based on a thermoplastic polymer material.

34. The cable according to claim 33, wherein said at least one covering layer is based on a thermoplastic polymer material in admixture with a dielectric liquid, wherein said thermoplastic polymer material is selected from:

(a) at least one propylene homopolymer or at least one copolymer of propylene with at least one olefin comonomer selected from ethylene and an alpha-olefin other than propylene, said homopolymer or copolymer having a melting point greater than or equal to 130° C. and a melting enthalpy of 20 J/g to 100 J/g; and (b) a mechanical mixture comprising at least one propylene homopolymer or copolymer of (a) and (c) at least one elastomeric copolymer of ethylene with at least one aliphatic alpha-olefin, or at least one propylene homopolymer or copolymer of (a) and (c) at least one elastomeric copolymer of ethylene with at least one aliphatic alpha-olefin and a polyene;

and wherein the concentration by weight of said dielectric liquid in said thermoplastic polymer material is lower than the saturation concentration of said dielectric liquid in said thermoplastic polymer material.

35. The cable according to claim 33, wherein said at least one covering layer is based on a thermoplastic polymer material in admixture with a dielectric liquid, wherein said thermoplastic polymer material comprises:

(i) at least 75% by weight, with respect to the total weight of the thermoplastic polymer material, of at least one copolymer of at least two alpha-olefin comonomers, said copolymer having a melting enthalpy lower than 25 J/g; and (ii) an amount equal to or less than 25% by weight, with respect to the total weight of the thermoplastic polymer material, of at least one propylene homopolymer or propylene copolymer with at least one alpha-olefin, said at least one propylene homopolymer or propylene copolymer having a melting enthalpy higher than 25 J/g and a melting point higher than 130° C.;

and wherein said covering layer has a melting enthalpy equal to or lower than 40 J/g, and the concentration by weight of said dielectric liquid in said thermoplastic polymer material is lower than the saturation concentration of said dielectric liquid in said thermoplastic polymer material.

* * * * *